US007296981B2

(12) United States Patent
Strong

(10) Patent No.: US 7,296,981 B2
(45) Date of Patent: Nov. 20, 2007

(54) PUMP HAVING INDEPENDENTLY RELEASABLE ENDS

(75) Inventor: Christopher L. Strong, Frederick, CO (US)

(73) Assignee: Illinois Tool Works Inc., Glenview, IL (US)

( * ) Notice: Subject to any disclaimer, the term of this patent is extended or adjusted under 35 U.S.C. 154(b) by 400 days.

(21) Appl. No.: 11/061,157

(22) Filed: Feb. 18, 2005

(65) Prior Publication Data

US 2006/0188380 A1 Aug. 24, 2006

(51) Int. Cl.
*F04B 39/00* (2006.01)

(52) U.S. Cl. ..... 417/454; 417/555.1; 417/554; 417/415; 92/71; 91/502

(58) Field of Classification Search ..... 417/259, 417/415, 454, 554, 555.1; 91/502; 92/71
See application file for complete search history.

(56) References Cited

U.S. PATENT DOCUMENTS

| | | | | |
|---|---|---|---|---|
| 1,538,911 | A | | 5/1925 | Taylor |
| 1,605,830 | A | | 11/1926 | Garber |
| 2,281,933 | A | | 5/1942 | Gage |
| 3,018,968 | A | * | 1/1962 | Levey ..... 239/124 |
| 3,074,351 | A | | 1/1963 | Foster |
| 3,536,424 | A | * | 10/1970 | Plos ..... 417/545 |
| 4,432,470 | A | | 2/1984 | Sopha |
| 4,775,303 | A | | 10/1988 | Liska |
| 5,435,697 | A | | 7/1995 | Guebeli et al. |
| 5,456,583 | A | * | 10/1995 | Handzel ..... 417/454 |
| 5,524,983 | A | * | 6/1996 | Dittgen et al. ..... 366/160.4 |
| 5,616,009 | A | | 4/1997 | Birdwell |
| 5,647,737 | A | | 7/1997 | Gardner et al. |
| 6,015,268 | A | | 1/2000 | Hetherington |
| 6,168,308 | B1 | | 1/2001 | Pittman et al. |
| 6,821,096 | B2 | | 11/2004 | Kosmyna et al. |

OTHER PUBLICATIONS

Design U.S. Appl. No. 29/216,034, Entitled "Pump" filed Oct. 28, 2004, Christopher L. Strong.

* cited by examiner

*Primary Examiner*—Anthony D. Stashick
*Assistant Examiner*—Leonard J Weinstein
(74) *Attorney, Agent, or Firm*—Fletcher Yoder

(57) ABSTRACT

In certain embodiments, a pump includes a first end section having a fluid inlet and a fluid intake valve, a second end section having a fluid outlet, and a midsection disposed between the first and second end sections, wherein the midsection includes a piston coupled to a drive member. The pump also includes a first set of bolts coupling the first end section to the midsection, and a second set of bolts coupling the second end section to the midsection, wherein the first and second end sections are independently releasable from the midsection via the first and second sets of bolts, respectively.

22 Claims, 5 Drawing Sheets

PUMP HAVING INDEPENDENTLY RELEASABLE ENDS

BACKGROUND

The present technique relates generally to pumping systems and, more specifically, to systems and methods for assembling and disassembling a pump.

Existing pumps, such as polyester resin pumps, have a plurality of annular sections that are integrally coupled together, such that the individual sections are not individually accessible for servicing, maintenance, repair, and so forth. For example, one typical pump includes a plurality of tie rods extending along the length of the pump, such that the tie rods secure all annular sections of the pump together in an integral manner. Unfortunately, this integral assembly of the pump prevents independent release and access of the individual sections of the pump.

Similarly, another typical pump includes a plurality of threaded annular sections that are threaded together at different positions along the length of the pump, such that the individual sections of the pump are not independently releasable and accessible when installed in a particular pumping system. In other words, the individual sections must be rotated with respect to one another during assembly or disassembly. Unfortunately, this rotational movement between the individual sections cannot be performed while the pump is installed within a system, because various pipes and mounting structures are coupled to the body of the pump. As a result, the entire pump must be removed from the particular pumping system to gain access to the various sections of the pump.

The forgoing and other existing pumps are so integrally coupled together and integrally coupled within the particular pumping system that access and servicing requires complete removal of the pump and/or complete disassembly of the pump. Therefore, the existing pumps are not amenable to independent at release, access, servicing, and repair of individual sections of the respective pump.

For these reasons, a technique is needed for independently releasing various sections of a pump, such that these sections can be independently accessed, serviced, and repaired.

BRIEF DESCRIPTION

In certain embodiments, a pump includes a first end section having a fluid inlet and a fluid intake valve, a second end section having a fluid outlet, and a midsection disposed between the first and second end sections, wherein the midsection includes a piston coupled to a drive member. The pump also includes a first set of bolts coupling the first end section to the midsection, and a second set of bolts coupling the second end section to the midsection, wherein the first and second end sections are independently releasable from the midsection via the first and second sets of bolts, respectively.

DRAWINGS

DETAILED DESCRIPTION

Figure 1:
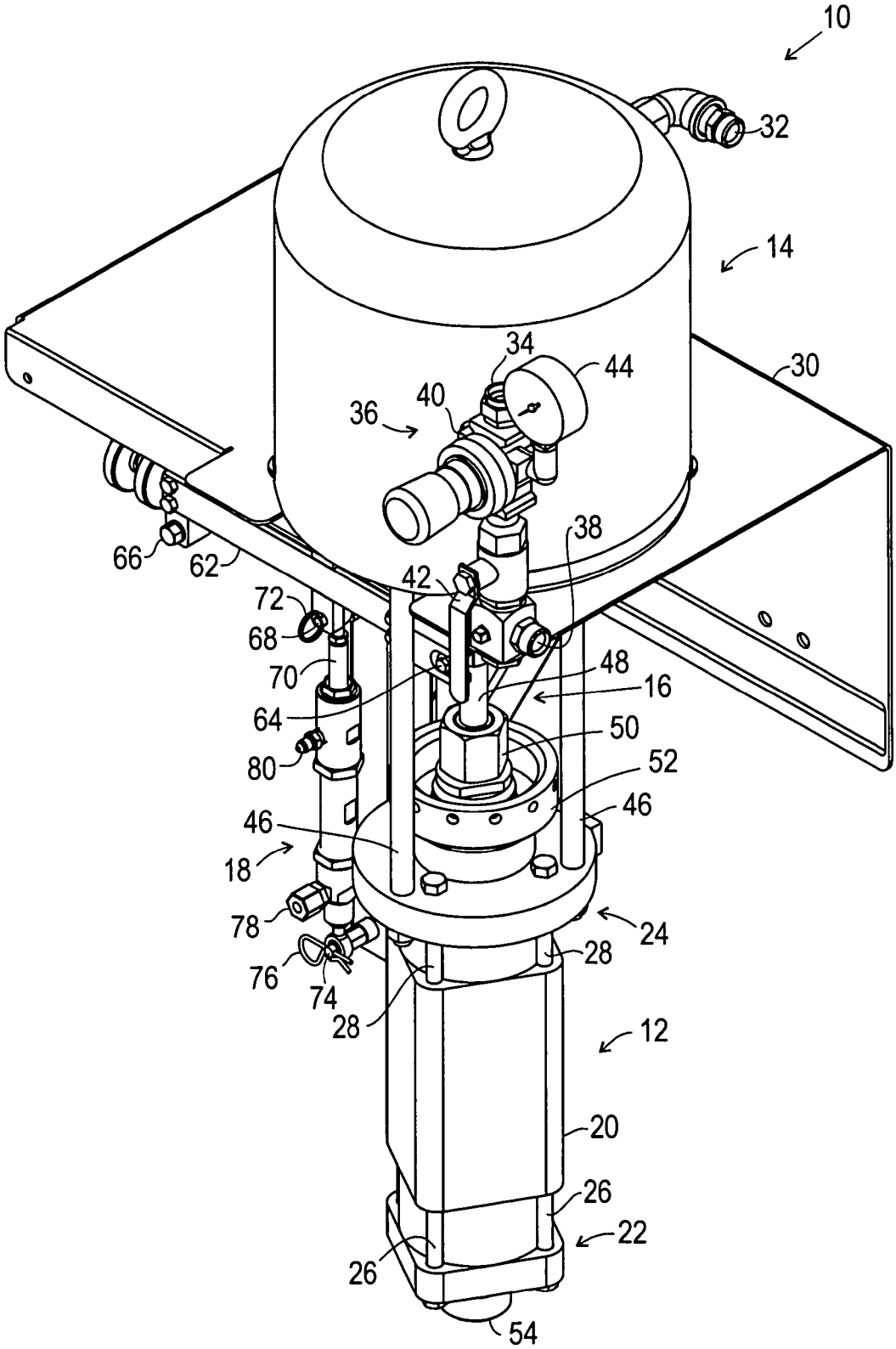
FIG. 1 is a perspective view of a pumping system having a primary pump and a secondary pump coupled to a motor via a drive section in accordance with embodiments of the present technique.

FIG. 1 is a perspective view of an exemplary pumping system 10 having a primary pump 12 coupled to a motor 14 via a transmission or drive section 16 in accordance with embodiments of the present technique. In addition, the illustrated pumping system 10 includes a secondary pump 18 coupled to the motor 14 via the transmission or drive section 16. As discussed in further detail below, the primary pump 12 includes a plurality of sections, such as a midsection 20 and opposite end sections 22 and 24, which end sections 22 and 24 are independently releasable via respective bolts 26 and 28.

These bolts 26 and 28 are independent from one another and, also, enable the sections 20, 22, and 24 to remain in a stationary position during assembly or disassembly. In other words, the midsection 20, or the end section 22, or the end section 24, or a combination thereof may remain coupled together, or coupled to a chassis or fluid conduits, while the bolts 26 and/or bolts 28 are installed or removed from the primary pump 12. For example, the end section 22 can be removed from the midsection 20 while the end section 24 remains coupled to the midsection 20 or, alternatively, the end section 24 can be removed from the midsection 20 while the end section 22 remains coupled to the midsection 20. Accordingly, various wearable and replaceable components, such as seals, guides, valves, pistons, and rings, can be selectively accessed by independently removing either one of the end sections 22 or 24. For these reasons, a service technician does not need to completely remove the primary pump 12 from the pumping system 10, nor does the technician need to completely disassemble the pump 12 when access is desired only in one end or the other of the pump 12.

As illustrated in FIG. 1, the pumping system 10 includes an enclosure or chassis 30 that supports the motor 14, the primary and secondary pumps 12 and 18, and the intermediate transmission or drive section 16. In the illustrated embodiment, the motor 14 is an air powered motor having an air inlet 32 that connects with an air outlet 34 of an air control assembly 36. The illustrated air control assembly 36 includes an air inlet 38 that connects with a remote or independent air supply. The air control assembly 36 also includes a pressure regulator 40 and an air valve 42 disposed between the air outlet 34 and the air inlet 38 to control the pressure and flow of the air through the air control assembly 36. The air control assembly 36 also includes a gauge 44 to indicate an air pressure flowing through the assembly 36 to the air inlet 32 of the motor 14. However, the air control assembly 36 and the motor 14 may be replaced with a variety of other motors and control assemblies, such as a gas powered motor, a hydraulic motor, an electric motor, electronic control circuits, software-based control interfaces, computers, and various electromechanical drives and control assemblies.

The illustrated transmission or drive section 16 transfers and/or converts a reciprocating motion, e.g., a linear reciprocating motion, by the motor 14 to the primary and secondary pumps 12 and 18. As illustrated, the enclosure or chassis 30 supports the primary pump 12 in a fixed position below the chassis 30 via a plurality of beams or support members 46. In a region between the enclosure or chassis 30 and the primary pump 12, the transmission or drive section 16 includes a pump drive rod 48, which reciprocally moves in an upward and downward linear motion as driven by the adjacent motor 14. This upward and downward reciprocal motion, in turn, drives internal pumping mechanisms within the primary pump 12, as discussed in further detail below. At the top end of the primary pump 12, the internal pumping mechanisms are coupled to the pump drive rod 48 via a nut 50.

Figure 2:
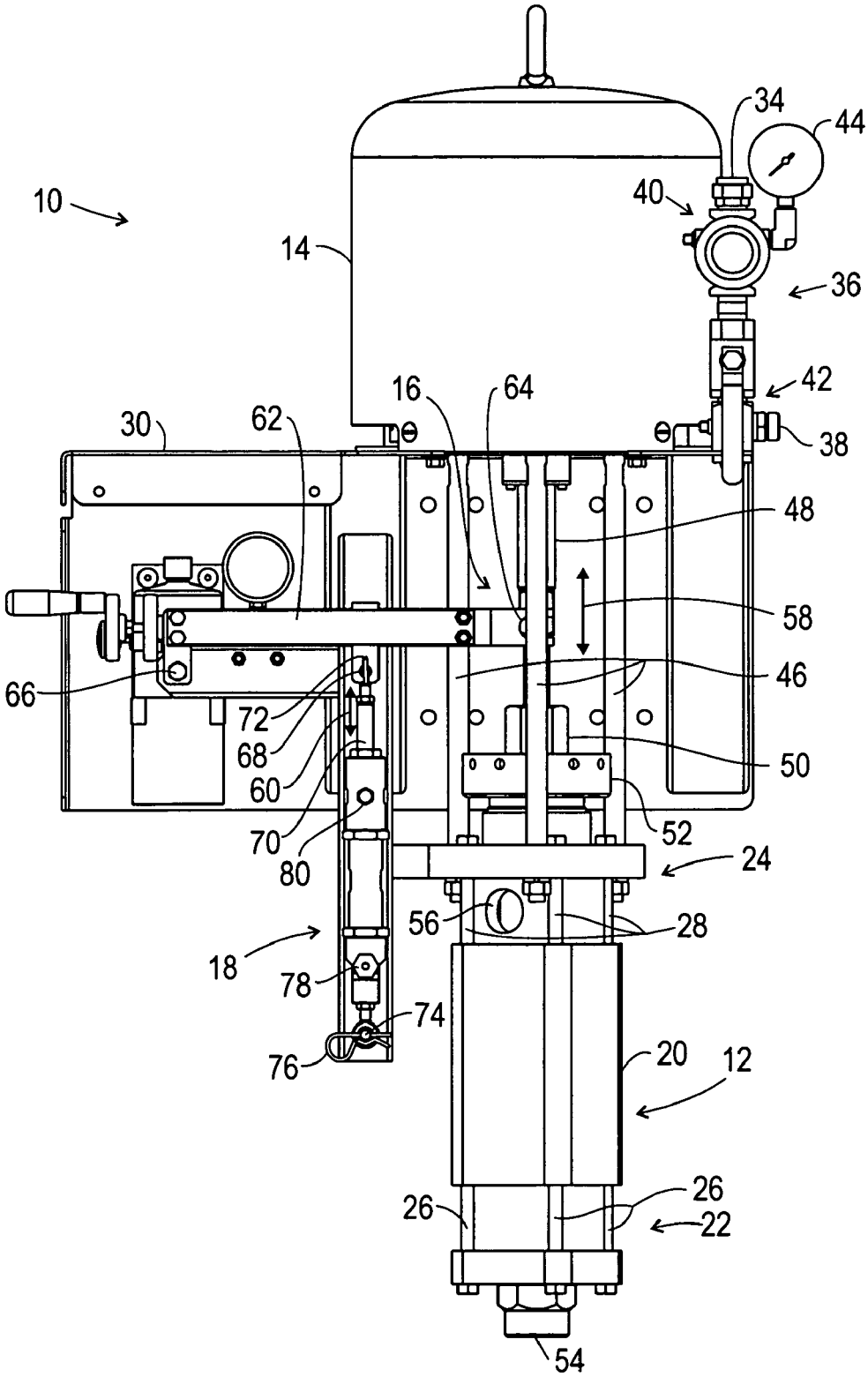
FIG. 2 is a side view of the pumping system illustrated in FIG. 1.

In addition, the primary pump 12 includes a fluid cup 52 in the sealing region between the pump drive rod 48 and the internal pumping mechanisms. In certain embodiments, this fluid cup 52 retains a fluid, such as a solvent compatible with the fluid being pumped by the primary pump 12, to maintain wetness and reliability of the seals in that region. In addition, the fluid cup 52 may function to capture fluids leaking from the primary pump 12 in the sealing region between the pump drive rod 48 and the internal pumping mechanisms of the primary pump 12. In operation, the primary pump 12 intakes a fluid, such as a polyester resin, at a primary fluid inlet 54 and pumps the fluid outward through a primary fluid outlet 56, as illustrated in FIG. 2. Other working fluids may include gel coat, paint, oil or solvent, water, or abrasive slurries, or a variety of coating materials. Depending on the particular application and working fluid(s), the primary and second pumps 12 and 18 may comprise a variety of pumping types and configurations.

FIG. 2 is a side view of the pumping system 10 illustrating a primary reciprocating motion 58 of the pump drive rod 48, which conveys a secondary reciprocating motion 60 to the secondary pump 18 via a slave arm 62 of the transmission or drive section 16 in accordance with embodiments of the present technique. As illustrated, the pump drive rod 48 directly transmits the primary reciprocation motion 58 in a generally linear manner from the motor 14 to the primary pump 12.

In turn, the pump drive rod 48 moves the slave arm 62 in the primary reciprocating motion 58 at a first pivot joint 64. In response to this movement at the first pivot joint 64, the slave arm 62 also pivots about a second pivot joint 66 at an opposite end from the first pivot joint 64. At an intermediate position between the first and second pivot joints 64 and 66, the slave arm 62 has a third pivot joint 68 coupled to a moveable drive member 70 of the secondary pump 18 via a retaining clip 72. In the illustrated embodiment, the slave arm 62 rotates about the first and second pivot joint 64 and 66 in a curved reciprocating motion, such that the slave arm 62 conveys only a portion (i.e., motion 60) of the primary reciprocating motion 58 to the moveable drive member 70. However, alternate embodiments of the transmission or drive section 18 and the slave arm 62 may convey equal or greater amounts (i.e., motion 60) of the primary reciprocating motion 58 to the secondary pump 18. At the opposite end from the slave arm 62, the secondary pump 18 is coupled to a portion of the enclosure or chassis 30 via a fourth pivot joint 74 and associated clip retainer 76.

In operation, the secondary reciprocating motion 60 drives the moveable drive member 70 inward and outward from the secondary pump 18, thereby drawing fluid in through a secondary fluid inlet 78 and pumping the fluid outward from a secondary fluid outlet 80. For example, in certain embodiments, the secondary pump 18 may transfer a catalyst for a polyester resin being pumped through the primary pump 12. In other embodiments, the primary and secondary pumps 12 and 18 may convey other fluids that are mixed together for a particular application, such as paint and other desired materials.

Figure 3:
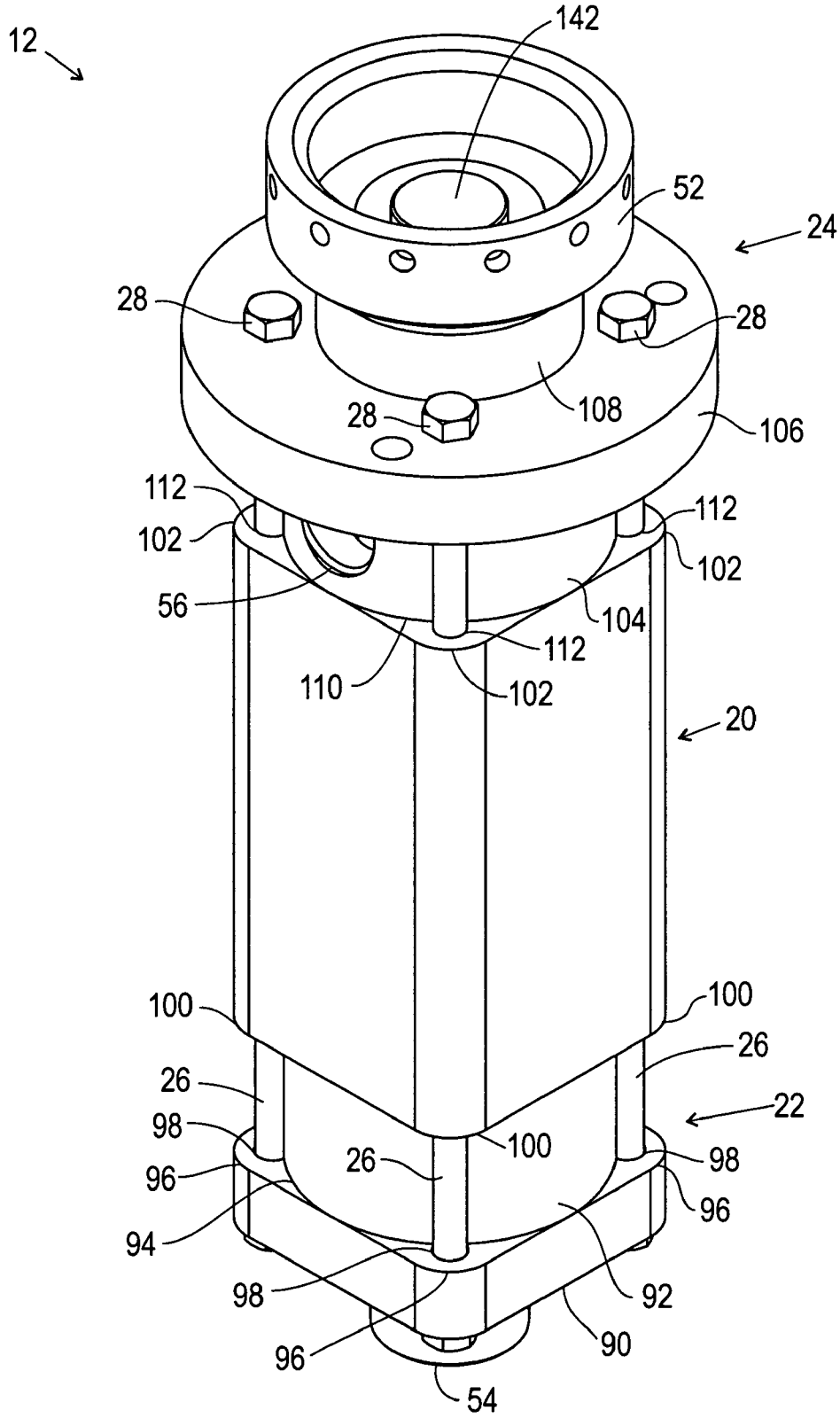
FIG. 3 is a perspective view of the primary pump illustrated in FIGS. 1 and 2.

FIG. 3 is a perspective view of the primary pump 12 illustrating various components of the end sections 22 and 24 coupled to the midsection 20 via the bolts 26 and 28, respectively. In certain embodiments, these bolts 26 and 28 may be replaced or supplemented with a variety of other fasteners, such as a latching member having a cam mechanism, a leveraging member, or another mechanism to compress the adjacent sections together without rotating the sections 20, 22, and 24 with respect to one another. In other words, the bolts 26 and 28 or various other fasteners may be used to assemble and disassemble the sections 20, 22, and 24 by a motion oriented along the length or longitudinal axis of the primary pump 12. Again, this lengthwise and/or axial motion of the fasteners, e.g., bolts 26 and 28, enables the primary pump 12 and its various sections 20, 22, and/or 24 to remain in place (with respect to one another and/or with respect to the chassis 30) during assembly and disassembly.

As mentioned above, the primary pump 12 may include a variety of pumping mechanisms, such as pistons, plungers, diaphragms, axial flow impellers, radial flow impellers, mixed radial/axial flow impellers, and so forth. These various pumping mechanisms can include single stage or multistage pumping devices and various components tailored to a particular application and working fluid. For example, working fluids having a relatively higher viscosity (e.g., polyester resin) or abrasive materials (e.g., abrasive slurries) benefit from certain types of displacement pumps, which can achieve high pressures with low pumping/drive velocities. In addition, embodiments of the primary pump 12 include a variety of wearable and replaceable components, such as o-rings and various seals, valves (e.g., ball valves), pistons and associated rings, guides, and so forth.

Turning now to the illustrated embodiment of FIG. 3, the end section 22 of the primary pump 12 includes a first flange or inlet seal section 90 having the primary fluid inlet 54. The illustrated end section 22 also includes an intake control or fluid valve section 92 between the first flange 90 and the midsection 20. In the illustrated embodiment, the first flange 90 and the fluid valve section 92 of the end section 22 are coupled to the midsection 20 via a set of four bolts 26, such that the end section 22 can be attached and released independently from components of the opposite end section 24. In certain embodiments, the first flange 90 and the fluid valve section 92 are either an integral component or separate from one another.

As illustrated in FIG. 3, the pump 12 has a geometry and configuration particularly well suited for coupling the end sections 22 and 24 to the midsection 20 in an independent manner. In certain embodiments, the first flange 90 and the fluid valve section 92 may have a variety of external shapes and internal mechanisms, as discussed in further detail below. However, the illustrated first flange 90 has a generally square or rectangular exterior structure, whereas the fluid valve section 92 has a generally annular or cylindrical shaped external structure. At an interface 94 between the first flange 90 and the fluid valve section 92, the first flange 90 has four corner portions 96 extending beyond the annular shaped periphery of the fluid valve section 92. In each of these corner portions 96, one of the bolts 26 extends through a receptacle 98 in the first flange 90, and then extends outside the annular shaped periphery of the fluid valve section 92 until the respective bolt 26 engages a threaded receptacle in the midsection 20 of the primary pump 12. Similar to the first flange 90, the illustrated midsection 20 has a generally square or rectangular external structure, such that the midsection 20 has corner portions extended outwardly from the annular shaped external structure of the fluid valve section 92. As discussed in further detail below, an embodiment of the midsection 20 has a generally cylindrical shaped interior. Accordingly, these protruding corner portions 100 advantageously provide structure (e.g., greater wall thickness) between the cylindrical interior and the rectangular exterior. In view of this greater thickness, the protruding corner portions 100 enable each of the bolts 26 to thread into the midsection 20, thereby securing the end section 22 to the midsection 20 independently from the opposite end section 24. In alternative embodiments, the various sections 20, 22, and 24 may have different externally shaped structures, which also provide sufficient wall thickness to receive bolts 26 and 28 independently in the opposite ends of the primary pump 12. For example, the midsection 20 may have a cylindrical shape to accommodate more or less than four bolts at each end, a triangular shape to accommodate three bolts at each end, or any other suitable geometry.

As further illustrated in FIG. 3, a set of four bolts 28 secure components of the end section 24 into corner portions 102 of the midsection 20 in a similar manner as described above with reference to the opposite end section 22. Specifically, the end section 24 includes an outlet seal section 104 having the primary fluid outlet 56, a second flange 106, a drive seal section 108, and the fluid cup 52 (e.g., solvent cup) described in detail above. Similar to the fluid valve section 92, the outlet seal section 104 has a generally annular or cylindrical shaped outer structure, whereas the midsection 20 has a generally rectangular or square shaped outer structure. At an interface 110 between the midsection 20 and the outlet seal section 104, the corner portions 102 of the midsection 20 protrude or extend outwardly from the annular shaped exterior of outlet seal section 104. In this manner, the midsection 20 has a relatively greater amount of structure (e.g., thicker wall) in the regions of these corner portions 102, because of the different internal and external geometries (e.g., cylindrical interior and rectangular exterior). Accordingly, the set of four bolts 28 extending through receptacles in the second flange 106 extend lengthwise along the exterior of the outlet seal section 104 until they reach the corner portions 102 of the midsection 20, where the bolts 28 thread into threaded receptacles 112 in each of the respective corner portions 102. Again, the corner portions 102 enable the bolts 28 to fasten the components of the end section 24 to the midsection 20 independently from the components of the opposite end section 22.

Advantageously, this ability to independently release either one of the opposite end sections 22 and 24 from the midsection 20 enables a service technician to release, access, service, repair, and/or replace components from the perspective of either one of the opposite end sections 22 and 24 of the primary pump 12. In addition, the use of separate bolts 26 and 28 and respective corner portions 100 and 102 at opposite end sections 22 and 24 enables the technician to release and access one or both of the end sections 22 and 24 in place within the overall pumping system 10. In other words, the primary pump 12 does not need to be removed from the pumping system 10 of FIGS. 1 and 2, because release of the bolts 26 and or 28 does not necessitate rotation of the sections 20, 22, and 24 with respect to one another, i.e., typical of pumps having threaded annular structures as discussed in detail above.

Figure 4:
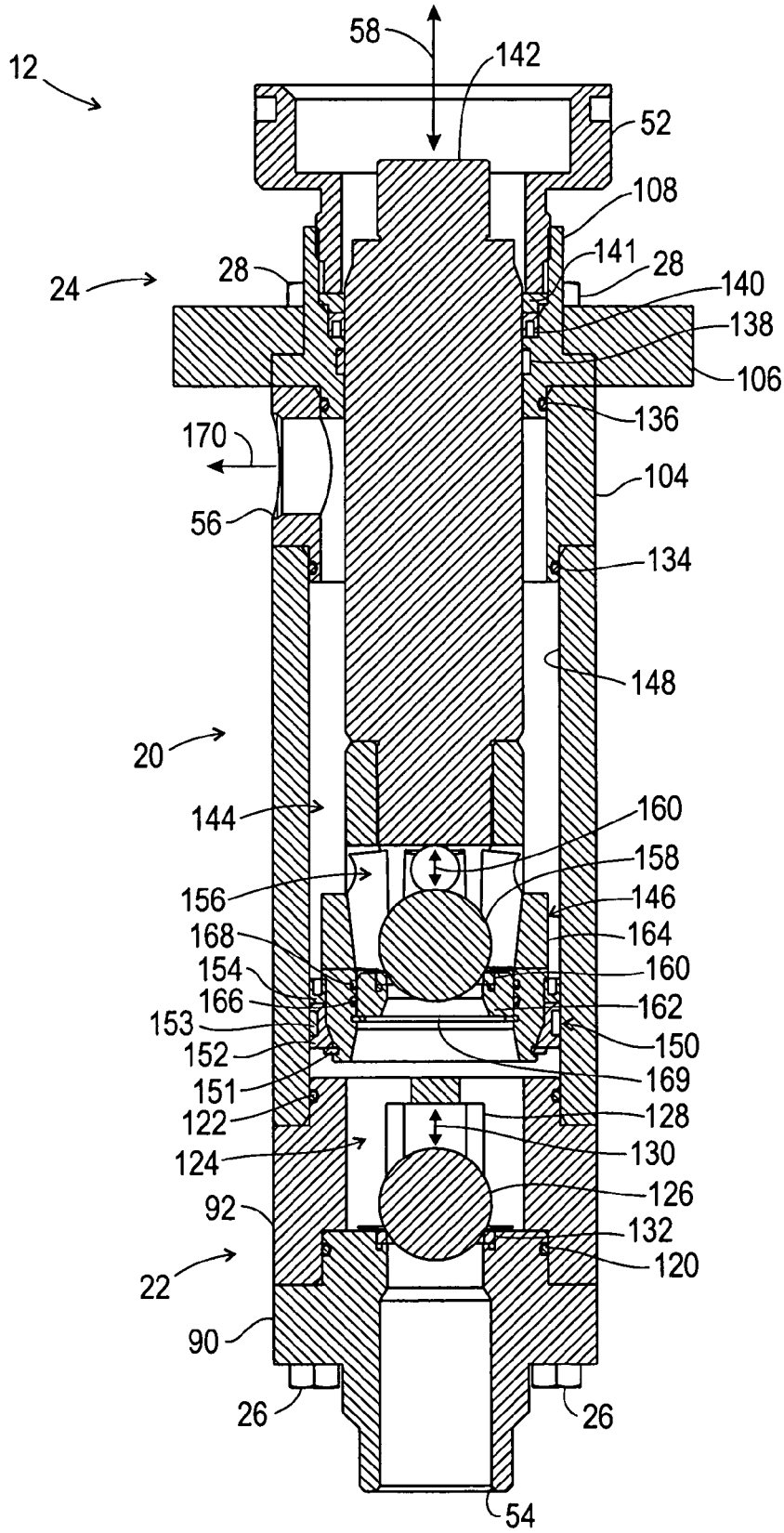
FIG. 4 is a cross-sectional side view of the primary pump illustrated in FIG. 3 in accordance with embodiments of the present technique.
Figure 5:
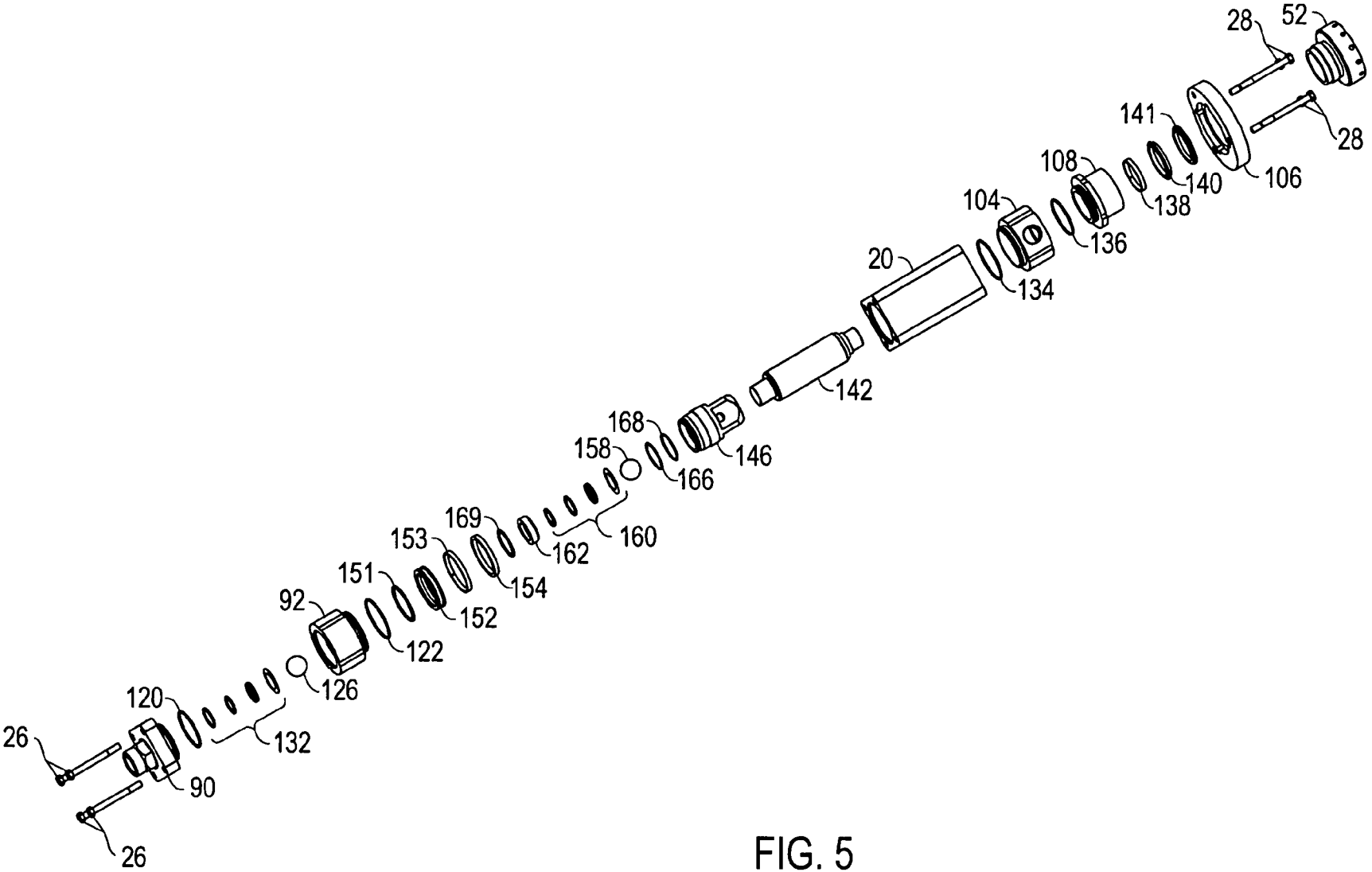
FIG. 5 is an exploded view of the primary pump illustrated in FIGS. 1-4 in accordance with embodiments of the present technique.

FIG. 4 is a cross-sectional side view of the primary pump 12 illustrating internal seals, wear components, moving components, and various other structures that may be accessed at one or both of the opposite end sections 22 and 24. As illustrated, the end section 22 comprises a first o-ring or seal 120 between the inlet seal section 90 and fluid valve section 92, and a second o-ring or seal between the fluid valve section 92 and the midsection 20. In addition, the end section 22 includes a fluid intake valve 124 having a ball member 126 that moves along a guide 128 in a path 130 as illustrated in FIG. 4. This ball member 126 seals against a third seal assembly 132, which may include a variety of plastic, metal, rubber, hard metals, or hard materials (e.g., ceramic or carbide), or other suitable materials having an annular shape to seal against the ball member 126. For example, the assembly 132 may include a set of four annular springs and/or seals, as illustrated in FIG. 5. These o-rings, seals, and/or guides 120, 122, and 132 and the fluid intake valve 124 are all wear components, which may be replaced at one or more time during the life of the primary pump 12. Accordingly, if servicing or replacement of one of these components is desired, then a service technician can release the bolts 26 to gain access to the end section 22 independently from the end section 24 as discussed in detail above.

As further illustrated in FIG. 4, the end section 24 also includes a plurality of seals and other wear components, which can be replaced or serviced by releasing the bolts 28 independently from the bolts 26. Specifically, the end section 24 includes a fourth o-ring or seal 134 between the midsection 20 and the outlet seal section 104, and a fifth o-ring or seal 136 between the outlet seal section 104 and the drive seal section 108. In addition, the end section 24 includes seals and/or guides 138 and 140 between the drive seal section 108 and inner pump rod or drive member 142. Furthermore, an annular retainer (e.g., a threaded annular structure) is coupled to the drive seal section 108 over the seals and/or guides 138 and 140, thereby retaining the seals and/or guides 138 and 140 between the drive seal section 108 and the drive member 142. Again, servicing or replacement of these seals and/or guides 134, 136, 138, and 140 may be desirable over the life of the primary pump 12. Accordingly, if servicing or placement is desired for these seals and/or guides 134, 136, 138, or 140, then a service technician can release the bolts 28 to facilitate removal of the outlet seal section 104, the second flange 106, the drive seal section 108, and the fluid cup 52 independently from the components at the opposite end section 22. As discussed in detail above, this independent access and release at the opposite end sections 22 and 24 is advantageous for servicing and repair, because the primary pump 12 can remain mounted within the overall pumping system 10 and can remain completely assembled with the exception of the particular end section 22 or 24 being released for servicing.

Inside the illustrated midsection 20, the primary pump 12 includes a piston assembly 144 comprising a piston 146, which is movably and sealingly disposed inside a cylinder or cylindrical interior 148 of the midsection 20. The illustrated piston 146 is coupled to an end of the inner pump rod or drive member 142. Specifically, the piston 146 has an annular shaped exterior, which moves reciprocally up and down along the cylindrical interior 148 of the midsection 20 in response to the primary reciprocating motion 58 of the inner pump rod or drive member 142. At an interface 150 between the piston 146 and the cylindrical interior 148, the piston assembly 144 includes one or more retainers 151 and 152, guides 153, and seals 154, such as a c-clip, a u-guide and c-guide, an o-ring or u-shaped seal, and so forth. The illustrated piston assembly 144 also includes a fluid pump valve 156 having a ball member 158 that moves along a path 160. As illustrated, the ball member 158 is seated against a disk, spring (e.g., a disk spring), and/or seal 160 of an annular assembly 162, which in turn is sealed and retained against an outer annular portion 164 of the piston 146 via o-rings or seals 166 and 168 and retainer 169 (e.g., c-clip).

Again, all of these seals, guides, and valve members are wear items, which may be serviced or replaced during the life of the primary pump 12. Accordingly, in the illustrated embodiment, these components of the midsection 20 may be accessed, serviced, and/or replaced by removing the bolts 28 at the end section 24, and then removing components of the end section 24 and subsequently removing the drive member 142 and the piston assembly 144. Alternatively, the components of the midsection 20 may be accessed, serviced, and/or replaced by removing the bolts 26 at the end section 22, and then removing components of the end section 22 and subsequently removing the drive member 142 and the piston assembly 144 as illustrated in FIG. 5. Again, the access and servicing of these components within the midsection 20 may be performed without disassembling the entire pump 12 and without removing the entire pump 12 from the overall pumping system 10.

In operation, a downward stroke of the drive member 142 and the piston assembly 144 forces internal fluids to pressure the ball member 126 in the end section 22 against the seal 132, thereby causing fluid pressure to build within the fluid valve section 92 such that the ball member 158 within the piston assembly 144 becomes unseated from the seal 160. In turn, further downward movement of the drive member 142 and the piston assembly 144 causes fluid to flow from the fluid valve section 92 into the midsection 20 through the interior of the piston 146.

Upon reversing from a downward stroke to an upward stroke, the piston assembly 144 creates a lower pressure in the fluid valve section 92 relative to the midsection 20, thereby forcing the ball member 158 to become reseated against the seal 160. As a result, the upward stroke of the piston assembly 144 moves all fluid within the midsection 20 upwardly toward the outlet seal section 104, where the fluid exits through the primary fluid outlet 56 as indicted by arrow 170. Simultaneously with this upward stroke, the pressure differential between the fluid valve section 92 and the midsection 20 during the upward stoke of the piston assembly 144 creates a pressure differential between the fluid valve section 92 and the primary fluid inlet 54 of the end section 22. More specifically, the fluid within the fluid valve section 92 is at a lower pressure than the fluid at the primary fluid inlet 54, thereby forcing the ball member 126 to become unseated from the seal 132. As a result, fluid enters through the primary fluid inlet 54 and fills the cavity between the piston assembly 144 and the first flange or inlet seal section 90.

As the drive member 142 and the piston assembly 144 continue to reciprocate in upward and downward strokes, the primary pump 12 continues to draw fluid through the fluid valve section 92 and to pump the fluid outwardly through the outlet seal section 104. Again, as discussed in detail above, many of these seals, rings, guides, valves, and other components become worn over time. Advantageously, the independent fastening mechanisms of the present technique enable the worn components to be serviced or replaced via access through one of the end sections 22 or 24 without completely disassembling the primary pump 12 or removing the primary pump 12 from the overall pumping system 10.

FIG. 5 is an exploded perspective view of the primary pump 12 illustrating the various components exploded from opposite ends of the primary pump 12 in accordance with embodiments of the present technique. If servicing is desired for the pump 12, then the release of bolts 26 enables access and servicing of the inlet seal section 90, o-ring 120, various seals and guides of the assembly 132, ball member 126, fluid valve section 92, o-ring 122 and various seals, guides, valves, and components of the piston assembly 144. Alternatively, removal of the bolts 28 at the end section 24 enables access to the seal 140, the guide 138, the drive seal section 108, the o-ring 136, the outlet seal section 104, and the o-ring 134. In addition, the drive member 142, piston 146, and other components of the piston assembly 144 may be accessed and serviced after removing the fluid cup 52, bolts 28, flange 106, drive seal section 108, and outlet seal section 104. Accordingly, a service technician can selectively gain access to the various components from either end of the primary pump 12. Depending on the particular servicing or repair issues, it may be desirable to independently access these various components from the first end section 22 or the second end section 24. Advantageously, the present technique allows such independent release, inspection, and servicing without disassembling the entire pump 12 or removing it from the overall pumping system 10.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A pump, comprising:

a first end section comprising a fluid inlet and a fluid intake valve;

a second end section comprising a fluid outlet;

a midsection disposed between the first and second end sections, wherein the midsection comprises a piston coupled to a drive member;

a first set of bolts coupling the first end section to the midsection; and a second set of bolts coupling the second end section to the midsection, wherein the first and second end sections are independently releasable from the midsection via the first and second sets of bolts, respectively;

wherein the midsection comprises a cylindrical interior and a rectangular exterior extending lengthwise between the first and second end sections;

wherein the midsection comprises a first set of threaded receptacles at first corner portions between the cylindrical interior and the rectangular exterior at a first end adjacent the first end section, and the midsection comprises a second set of threaded receptacles at second corner portions between the cylindrical interior and the rectangular exterior at a second end adjacent the second end section.

2. The pump of claim 1, wherein the fluid intake valve is configured to close the fluid inlet during movement of the piston in a first direction from the second end section to the first end section and the fluid intake valve is configured to open the fluid inlet during movement of the piston in a second direction from the first end section to the second end section, and the piston comprises another valve configured to open during movement of the piston in the first direction and the other valve is configured to close during movement of the piston in the second direction.

3. The pump of claim 1, wherein the midsection comprises a cylinder oriented lengthwise between the first and second end sections, and the piston and drive member extend lengthwise along the midsection.

4. The pump of claim 1, wherein the fluid intake valve comprises a first ball valve and the piston comprises a second ball valve.

5. The pump of claim 1, wherein the first and second end sections comprise a plurality of seals.

6. The pump of claim 1, comprising a fluid retention cup coupled to the second end section, wherein the drive member extends lengthwise along the midsection and outwardly through the second section and the fluid retention cup.

7. The pump of claim 1, comprising a motor coupled to the drive member, wherein the motor is configured to move the drive member in a reciprocating linear motion.

8. The pump of claim 1, wherein the first end section, the midsection, and the second end section are arranged one after another along a longitudinal axis.

9. The pump of claim 1, wherein the first set of bolts is configured to couple with the first set of threaded receptacles to linearly bias the first end section into a first sealed relationship with the midsection, the second set of bolts is configured to couple with the second set of threaded receptacles to linearly bias the second end section into a second sealed relationship with the midsection.

10. The pump of claim 1, wherein the mid section does not connect to a first or second end section by a threaded annular surface extending lengthwise from the rectangular exterior or the cylindrical interior of the mid section along a central axis.

11. The pump of claim 1, wherein the first, second, and mid sections do not include tie rods to couple the sections together.

12. The pump of claim 1, wherein the fluid inlet of the first end section and the fluid outlet of the second end section are configured to couple to respective fluid conduits independent from the first set of bolts and the second set of bolts, respectively.

13. A system, comprising:

a motor;

a drive mechanism coupled to the motor;

a first pump comprising a fluid intake section, a fluid outlet section, and a fluid displacement section disposed between the fluid intake and outlet sections along an axis, wherein the fluid displacement section comprises a reciprocating pumping mechanism operable along the axis, and wherein the fluid intake and outlet sections are independently releasable from the fluid displacement section via independent fasteners operable without rotating the fluid intake and outlet sections relative to the fluid displacement section;

wherein the fluid displacement section comprises a cylindrical interior and a rectangular exterior extending lengthwise between the fluid intake and outlet sections;

wherein the fluid displacement section comprises a first set of threaded receptacles at first corner portions between the cylindrical interior and the rectangular exterior at a first end adjacent the fluid intake section, and the fluid displacement section comprises a second set of threaded receptacles at second corner portions between the cylindrical interior and the rectangular exterior at a second end adjacent the fluid outlet section.

14. The system of claim 13, comprising a chassis supporting the motor and the pump, wherein the fluid intake section, or the fluid displacement section, or the fluid outlet section is releasable from the first pump without releasing other sections of the first pump from the chassis.

15. The system of claim 13, comprising a second pump coupled to the drive mechanism.

16. The system of claim 15, wherein the drive mechanism comprises a linearly reciprocating member coupled to the reciprocating pumping mechanism of the first pump and an arm pivotably coupled to the second pump.

17. The system of claim 15, wherein the first and second pumps are configured to pump first and second fluids, respectively, for mixing with one another.

18. The system of claim 13, wherein the fasteners comprise a first set of threaded fasteners coupling the fluid intake section to the fluid displacement section via the first set of threaded receptacles, and the fasteners comprise a second set of threaded fasteners coupling the fluid outlet section to the fluid displacement section via the second set of threaded receptacles.

19. The system of claim 13, wherein the independent fasteners do not include flow passages.

20. The system of claim 13, wherein the independent fasteners comprise a first set of threaded fasteners configured to couple with the first set of threaded receptacles to linearly bias the fluid intake section into a first sealed relationship with the fluid displacement section, and a second set of threaded fasteners configured to couple with the second set of threaded receptacles to linearly bias the fluid outlet section into a second sealed relationship with the fluid displacement section.

21. The system of claim 13, wherein the fluid displacement section comprises a first set of fastener connectors at first corner portions at a first end adjacent the fluid intake section, the fluid displacement section comprises a second set of fastener connectors at second corner portions at a second end adjacent the fluid outlet section, and the independent fasteners comprise first and second fasteners configured to couple to the first and second sets of fastener connectors, respectively.

22. The system of claim 13, comprising a drive rod extending through a solvent cup and the fluid intake section, or the fluid outlet section, or the fluid displacement section, or a combination thereof, wherein the drive rod is internally coupled to a piston and is externally coupled to the drive mechanism.

* * * * *